US011105154B1

(12) United States Patent
Wesson

(10) Patent No.: US 11,105,154 B1
(45) Date of Patent: Aug. 31, 2021

(54) MUD MOTOR BEARING AND TOP SUB ROTOR CATCH SYSTEM

(71) Applicant: Osado Innovations, LLC, Oklahoma City, OK (US)

(72) Inventor: Shea Keller Wesson, Norman, OK (US)

(73) Assignee: Osado Innovations, LLC, Midland, TX (US)

( * ) Notice: Subject to any disclaimer, the term of this patent is extended or adjusted under 35 U.S.C. 154(b) by 0 days.

(21) Appl. No.: 16/896,533

(22) Filed: Jun. 9, 2020

(51) Int. Cl.
*E21B 4/02* (2006.01)
*E21B 4/00* (2006.01)

(52) U.S. Cl.
CPC ..... *E21B 4/003* (2013.01); *E21B 4/02* (2013.01)

(58) Field of Classification Search
CPC ..... E21B 4/02; E21B 4/003
See application file for complete search history.

(56) References Cited

U.S. PATENT DOCUMENTS 5,165,492 A 11/1992 Beasley
6,145,602 A 11/2000 Kutinsky
7,063,175 B1 6/2006 Kerstetter
9,194,181 B2 11/2015 Connell et al.
9,303,466 B2 4/2016 Makelki et al.
9,976,349 B2 5/2018 Altimas
2015/0060141 A1* 3/2015 Leuenberger ..... E21B 44/00 175/40

FOREIGN PATENT DOCUMENTS

CA 2997210 A1 10/2015

* cited by examiner

*Primary Examiner* — Giovanna Wright
(74) *Attorney, Agent, or Firm* — Bruce P. LaBrie; Resolution Legal Group

(57) ABSTRACT

A bottom hole assembly is provided, having a housing having a housing lubricant channel; a motor having a rotor and a stator; a mandrel within the housing that rotates when drilling mud flows through the motor; a flex shaft within the housing that includes an internal fluid path for drilling mud to flow into the mandrel; a bushing between the housing and the mandrel having a spiral lubricant channel configured to pump lubricant while the mandrel rotates, such that lubricant in the housing lubricant channel returns to the spiral lubricant channel; first and second on-bottom thrust bearings; and a two stage rotor catch housing attached to the motor and having an internal shoulder, a rotor catch shaft, and a rotor catch nut attached to an upper end of the rotor catch shaft.

20 Claims, 5 Drawing Sheets

MUD MOTOR BEARING AND TOP SUB ROTOR CATCH SYSTEM

CROSS-REFERENCE TO RELATED APPLICATION

None.

BACKGROUND

An oil and gas well is created by drilling a wellbore that extends from a desired surface site to a certain depth or distance into the ground. The wellbore penetrates the underlying earth and various geologic formations therein. With proper planning and placement, one or more of the geologic formations penetrated by the wellbore will include commercial quantities of hydrocarbons such as oil and gas. The wellbore can extend vertically, at an angle and/or horizontally through the earth.

A drilling rig is placed on the surface at the site of the desired well. In many drilling operations, drill pipe associated with the drilling rig is rotated at the surface by a kelly drive or top drive and includes a drill bit at its lower end to drill into the earth. The drill pipe can be attached to succeeding sections of drill pipe as the bit penetrates the earth. The column or string of drill pipe and other components is referred to as a drill string and transmits drilling fluid, also referred to as drilling mud, to the drill bit. In some applications, rotation of the drill bit is accomplished by other equipment in the drill string, such as a mud motor. Alternatively, coiled tubing can be used instead of drill pipe, which can speed a drilling operation because it eliminates the need to connect or disconnect sections of drill pipe during tripping in and out of the wellbore.

As the wellbore is being drilled the drilling fluid is continuously circulated from the surface through the wellbore and back to the surface. The drilling fluid flows through the coiled tubing or the drill pipe and functions to remove cuttings from the borehole, control formation pressure, and cool and lubricate the drill bit. After the wellbore is drilled to a certain or target depth, casing (typically metallic casing) is usually inserted and cemented in place in the now completed wellbore. The casing can extend to the total depth (TD) of the wellbore. The casing isolates and seals off various geologic zones that have been penetrated by the wellbore and serves multiple other purposes. Cement material is usually injected around the casing and allowed to harden into an annular sheath around the casing. The cement sheath physically supports, positions and protects the casing in the wellbore and bonds the casing to the walls of the wellbore such that the undesirable migration of fluids between zones or formations penetrated by the wellbore is prevented.

The bottom hole assembly (BHA) is the lowest part of the drill string, extending from the coiled tubing or drill pipe to the bit. The BHA can include drill collars, reamers, bit subs, bits, measurement and logging instruments, mud motors, and other constituents that are useful in drilling. A mud motor is a drilling tool placed in the drill string to provide power to the drill bit during a drilling operation. The drilling mud creates circular motion in the mud motor as the mud is pumped down the hollow coiled tubing or drill string. The drilling mud is circulated back up the annulus (the void between the drill string and the casing or open hole).

The use of rotational components in the BHA requires the use of bearings to maintain the positioning of rotating parts and to protect components. The weight of the drill string is useful for providing weight on the bit during drilling but can cause parts of the BHA to be damaged. Likewise, during portions of the operation when the BHA is not on the bottom of the hole, elongation of the elements of the BHA can result from the weight of the components, also requiring protective bearings to support the weight.

A rotor in the mud motor rotates relative to a stator in the mud motor. The upper end of the stator is attached to the coiled tubing or drill string, and the lower end of the rotor is attached to equipment to be rotated by the rotor. Parts of the motor can break, causing a portion of the BHA to be lost in the hole. The likelihood of this occurrence increases with the added stress put on the BHA during horizontal drilling because of the bends in the well through which the BHA must pass. When parts of the BHA are left in the hole, an expensive and time-consuming fishing operation may ensue, or in some cases the well must be abandoned.

SUMMARY

In one aspect, a bottom hole assembly (BHA) is disclosed herein. The BHA comprises a housing, a motor, a mandrel, a flex shaft, a bushing, first and second on-bottom thrust bearings, and a rotor catch housing. The housing has a lubricant channel and the motor has a rotor and a stator attached to the housing. The mandrel is disposed within the housing and rotates when drilling mud flows through the motor. The flex shaft, which is within the housing between the motor and the mandrel, includes an internal fluid path for drilling mud to flow into the mandrel. Drilling mud flows between the flex shaft and the housing at an upper end of the flex shaft and flows in the internal fluid path at a lower end of the flex shaft.

The bushing is between the housing and the mandrel and has a spiral lubricant channel configured to pump lubricant while the mandrel rotates. The lubricant in the housing lubricant channel returns to the spiral lubricant channel. First and second on-bottom thrust bearings are disposed between the housing and the mandrel.

The rotor catch housing is attached to the stator and has an internal shoulder, a rotor catch shaft within the rotor catch housing, and a rotor catch nut attached to an upper end of the rotor catch shaft. The rotor is attached to a lower end of the rotor catch shaft. An enlarged portion of the rotor catch shaft is configured to engage the stator when the rotor moves in a downward direction and the rotor catch nut is configured to engage the internal shoulder when the rotor moves in a downward direction. Engagement of the internal shoulder or the stator blocks the flow of drilling mud.

BRIEF DESCRIPTION OF THE DRAWINGS

The drawings included with this application illustrate certain aspects of the embodiments described herein. However, the drawings should not be viewed as exclusive embodiments. The subject matter disclosed is capable of considerable modifications, alterations, combinations, and equivalents in form and function, as will occur to those skilled in the art with the benefit of this disclosure.

DETAILED DESCRIPTION

Figure 1:
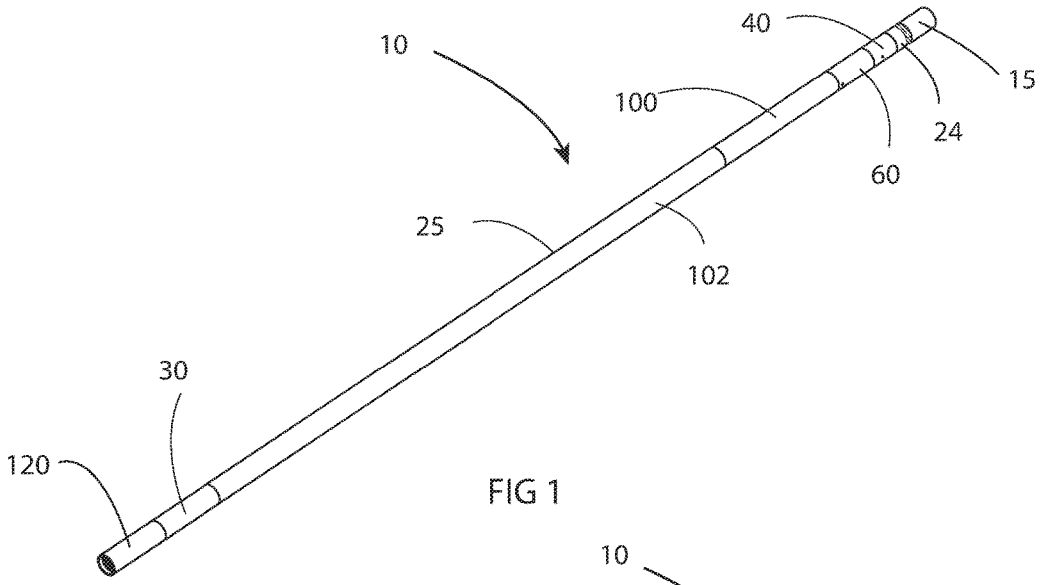
FIG. 1 is a perspective view of one embodiment of the motor bearing and rotor catch system disclosed herein.

The present disclosure may be understood more readily by reference to this detailed description. Numerous specific details are set forth in order to provide a thorough understanding of the various embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein.

In one aspect, this disclosure provides a bottom hole assembly. In one embodiment, the bottom hole assembly comprises:

a housing having a housing lubricant channel;

a motor having a rotor and a stator, wherein the stator is attached to the housing;

a mandrel disposed within the housing that rotates when drilling mud flows through the motor;

a flex shaft within the housing and between the motor and the mandrel that includes an internal fluid path in the flex shaft for drilling mud to flow into the mandrel, wherein the drilling mud flows between the flex shaft and the housing at an upper end of the flex shaft and flows in the internal fluid path at a lower end of the flex shaft;

a bushing between the housing and the mandrel having a spiral lubricant channel configured to pump lubricant while the mandrel rotates, such that lubricant in the housing lubricant channel returns to the spiral lubricant channel;

first and second on-bottom thrust bearings disposed between the housing and the mandrel; and a rotor catch housing attached to the stator and having an internal shoulder, a rotor catch shaft within the rotor catch housing, and a rotor catch nut attached to an upper end of the rotor catch shaft, wherein the rotor is attached to a lower end of the rotor catch shaft such that an enlarged portion of the rotor catch shaft is configured to engage the stator when the rotor moves in a downward direction and the rotor catch nut is configured to engage the internal shoulder when the rotor moves in a downward direction, and wherein the engagement of the stator or the internal shoulder blocks the flow of drilling mud.

In another embodiment, the bottom hole assembly comprises:

a housing having a housing lubricant channel;

a motor having a rotor and a stator, wherein the stator is attached to the housing;

a mandrel disposed within the housing that rotates when drilling mud flows through the motor;

a flex shaft within the housing and between the motor and the mandrel that includes an internal fluid path in the flex shaft for drilling mud to flow into the mandrel, wherein the drilling mud flows between the flex shaft and the housing at an upper end of the flex shaft and flows in the internal fluid path at a lower end of the flex shaft;

a bushing between the housing and the mandrel having a spiral lubricant channel configured to pump lubricant while the mandrel rotates, such that lubricant in the housing lubricant channel returns to the spiral lubricant channel;

first and second on-bottom thrust bearings disposed between the housing and the mandrel; and a rotor catch housing attached to the stator and having an internal shoulder, a rotor catch shaft within the rotor catch housing, and a rotor catch nut attached to an upper end of the rotor catch shaft, wherein the rotor is attached to a lower end of the rotor catch shaft such that an enlarged portion of the rotor catch shaft is configured to engage the stator when the rotor moves in a downward direction and the rotor catch nut is configured to engage the internal shoulder when the rotor moves in a downward direction, and wherein the engagement of the stator or the internal shoulder blocks the flow of drilling mud.

In yet another embodiment, the bottom hole assembly comprises:

a motor having a rotor and a stator, wherein the rotor rotates when drilling mud is pumped into the motor;

a flex housing having a flex shaft, wherein the flex shaft is attached to the rotor and a passage in the flex shaft transmits drilling mud;

a mandrel attached to the flex shaft, wherein drilling mud that flows through the passage in the flex shaft flows into the mandrel;

a housing attached to the flex housing, having a bushing between the housing and the mandrel and having a housing lubricant channel, wherein the bushing includes a spiral lubricant channel configured to pump lubricant while the mandrel rotates, such that lubricant in the housing lubricant channel returns to the spiral lubricant channel; and a rotor catch housing attached to the stator and having an internal shoulder, a rotor catch shaft within the rotor catch housing, and a rotor catch nut attached to an upper end of the rotor catch shaft, wherein the rotor is attached to a lower end of the rotor catch shaft such that an enlarged portion of the rotor catch shaft is configured to engage the stator when the rotor moves in a downward direction before the rotor catch nut engages the internal shoulder when the rotor moves in a downward direction, and wherein the engagement of the stator blocks the flow of drilling mud.

As used herein, a "well" means a drilled wellbore and can include the geologic units surrounding or adjacent to the wellbore.

As used herein and in the appended claims, a bottom hole assembly (BHA) is the lowest part of the drill string, extending from coiled tubing or drill pipe to the bit. For example, the BHA can include drill collars, reamers, bit subs, bits, measurement and logging instruments, mud motors, and other constituents that are useful in drilling. For different drilling applications, a BHA can include different elements. For example, a BHA may include a mud motor or a logging instrument, but in other applications it may include a mud motor and a bit, but no logging instrument. "Bottom" generally refers to the lowest portion of the BHA or other part of the drill string or wellbore being referenced, but it will be understood that "bottom" and "top" are relative terms, especially in view of a well that is not strictly vertical and can be any orientation, such as horizontal.

As used herein and in the appended claims, "housing" means an outside case of a downhole tool. For example, a BHA can include a housing, made of steel or other material, that isolates internal parts of the downhole tool from the environment within the well. A housing can be comprised of multiple pieces that connect together. For example, parts of a housing can include threaded portions that attach at their respective ends, or the pieces of the housing can be bolted, welded, or attached in various other ways.

As used herein and in the appended claims, "lubricant" means a substance that is used between surfaces in mutual contact to reduce friction, which in turn reduces heat as the surfaces move. For example, oil is a lubricant and can be used within a housing. As parts rotate within a housing, oil can reduce friction and cool parts that are in contact. Lubricants can be blended in a great variety of specifications.

As used herein and in the appended claims, a "housing lubricant channel" is a grooved or inset area that permits the flow of lubricant. For example, the housing can include an axial groove in which lubricant flows. As another example, a lubricant channel can be a variety of shapes wherein lubricant migrates along its length, such as along an interior groove of the housing.

As used herein and in the appended claims, a "mud motor" or "motor" means a motor in a drill string. For example, a BHA can include a mud motor that is powered by drilling fluid pumped from the surface. The motor can create rotational motion for driving other constituents that are a part of the BHA, such as a drill bit, for example. A mud motor includes a rotor that rotates relative to a stationary stator. For example, a mud motor can be a progressive cavity positive displacement pump, wherein the rotor spins when drilling mud or drilling fluid is pumped down a well and into the mud motor. For example, the rotor can rotate a bit, although other parts can be attached to the drill string between the rotor and the bit.

As used herein and in the appended claims, a "mandrel" means a shaft that can reside within a housing that can spin within a BHA. For example, a mandrel can be constructed of steel or other rigid material that includes a means for connecting to a drill bit at a bottom end. A mandrel can also include a hollow shaft that permits the flow of drilling mud to the drill bit. A mandrel preferably includes a means to attach its top end to a spinning portion of the BHA.

As used herein and in the appended claims, "flex shaft" means an elongated bendable shaft that is part of a BHA. For example, a flex shaft can be constructed of titanium and can flex as the BHA moves through the well. A flex shaft can also function as a C-V joint. For example, the flex shaft can transmit power at a variable angle as the BHA bends in sloped portions of the well. A flex shaft can facilitate the movement of drilling fluid through the BHA. For example, the flex shaft can include one or more passages through which drilling fluid enters and flows toward or into the mandrel.

As used herein and in the appended claims, "bushing" means a sleeve or lining adjacent something that rotates. For example, a steel alloy bushing can reside in the housing and the mandrel can rotate within the housing. A bushing can include a path for lubricant to migrate. For example, a spiral lubricant channel can be included on a surface of the bushing so that rotation of the mandrel causes lubricant to be "pumped" along the channel.

As used herein and in the appended claims, a "thrust bearing" means a type of rotary bearing that allows rotation between parts but is designed to support a predominately axial load. For example, an on-bottom thrust bearing in a BHA can allow rotation between a mandrel and a housing when the BHA is on the bottom of the wellbore, and can also support an axially load such as a drill string or coiled tubing as well as the weight of the BHA, drilling mud, and other constituents within the well. As another example, an off-bottom thrust bearing in a BHA can allow rotation between a mandrel and a housing when the BHA is not at the bottom of the wellbore and can support an axially load such the BHA.

As used herein and in the appended claims, "rotor catch housing" means an outside case of a portion of a downhole tool that protects a rotor from falling from a BHA. The rotor catch housing can protect interior parts of the tool from the harsh elements in the wellbore. A "rotor catch nut" means an enlarged portion of the rotor catch shaft. For example, a rotor catch housing can enclose a rotor catch shaft, internal shoulder, and a rotor catch nut. The rotor catch housing can allow the flow of drilling fluid to the motor. The rotor catch housing can also stop the flow of drilling mud to the motor. For example, a portion of the rotor catch shaft can engage a stator and block the flow of drilling fluid to the motor. For example, the rotor catch nut can be a nut that attaches to the rotor catch shaft, or it can also be an enlarged portion of the rotor catch shaft. An additional enlarged portion of the rotor catch shaft can also be included in the rotor catch shaft, separate from the rotor catch nut. The rotor catch nut can be a unitary part of the rotor catch shaft or can be removable.

As used herein and in the appended claims, a "balance piston" means a mechanism that regulates pressure across a barrier. For example, the BHA can include a balance piston that seals a portion of the housing that includes the lubricant. The balance piston can regulate pressure changes in the lubricant.

As used herein and in the appended claims, a "retaining bushing" means a sleeve or lining adjacent a rotating part. For example, a steel alloy or other metal alloy can trap a portion of the BHA to the mandrel. The retaining bushing can reside in the housing and the mandrel can rotate within the housing.

As used herein and in the appended claims, a "flex shaft nut" means a piece of hardware that secures a portion of a downhole tool to a shaft. For example, a flex shaft nut can be attached to a mandrel, thereby axially securing pieces within the housing.

Referring now to FIGS. 1-4 of the drawings, one embodiment of the bottom hole assembly for use in a wellbore as disclosed herein, generally designated by the reference numeral 10, will be described.

As shown by FIGS. 1-4, the BHA is shown in various assembled and cutaway views. FIG. 1 shows the BHA in an assembled form with the mandrel 15, housing 20, motor 25, rotor catch 30, and top sub 120. The mandrel 15 is preferably adapted to attach to a drill bit (not shown) at inset portion 22, such as by a threaded connection in which the drill bit is threaded into the inset portion 22, which can also be seen in FIG. 13. The mandrel 15 preferably includes a fluid path 17 for the movement of drilling mud.

Figure 2:
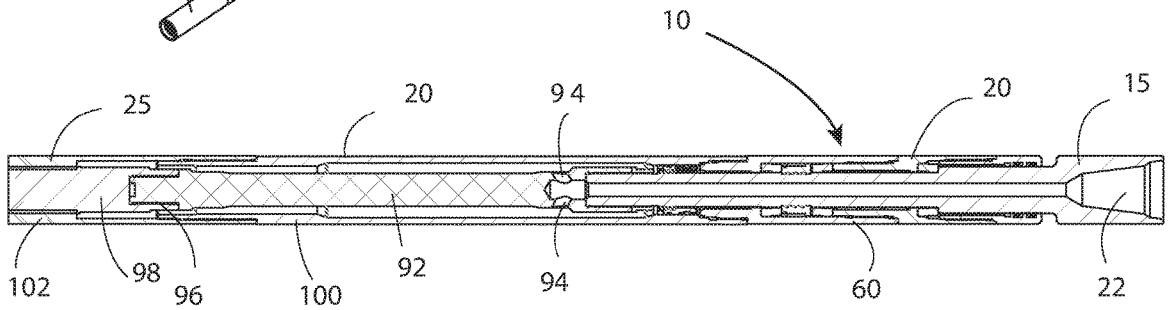
FIG. 2 is a partial cutaway view of a portion of one embodiment of the motor bearing and rotor catch system disclosed herein.
Figure 4:
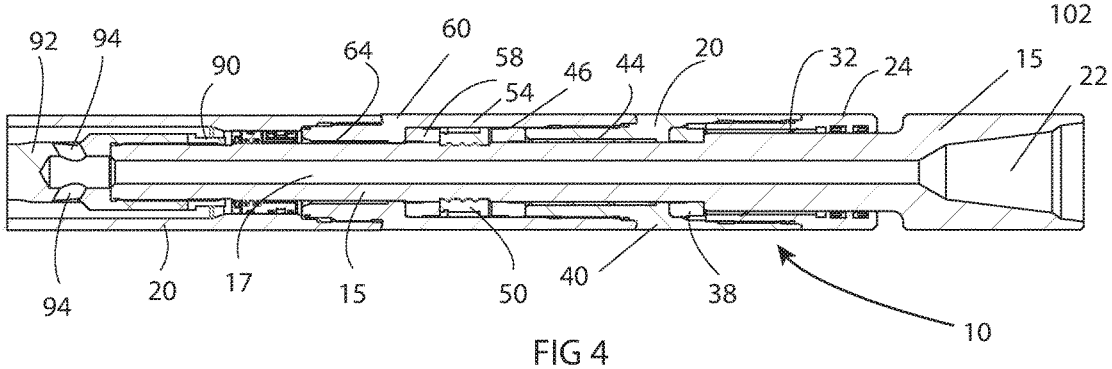
FIG. 4 is a partial cutaway view of a portion of one embodiment of the motor bearing and rotor catch system disclosed herein.
Figure 5:
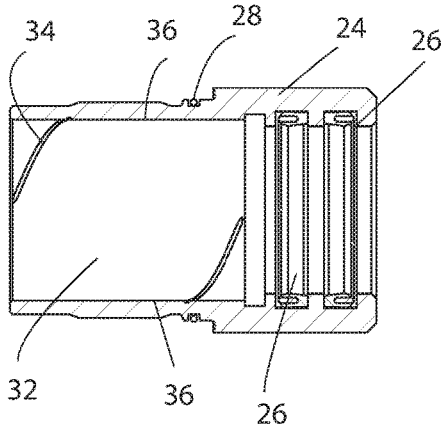
FIG. 5 is a partial cutaway view of a portion of one embodiment of the motor bearing and rotor catch system disclosed herein.

Referring also to FIG. 5, shown therein is a portion of the housing 20 referred to as the radial housing 24. In a presently preferred embodiment, the radial housing 24 includes seals 26, O-ring 28, and bushing 32. In other preferred embodiments, the bushing includes spiral lubricant channel 34 and the radial housing 24 includes housing lubricant channel 36. As can be seen in FIGS. 2 and 4, the mandrel 15 is within bushing 32 and radial housing 24.

Figure 6:
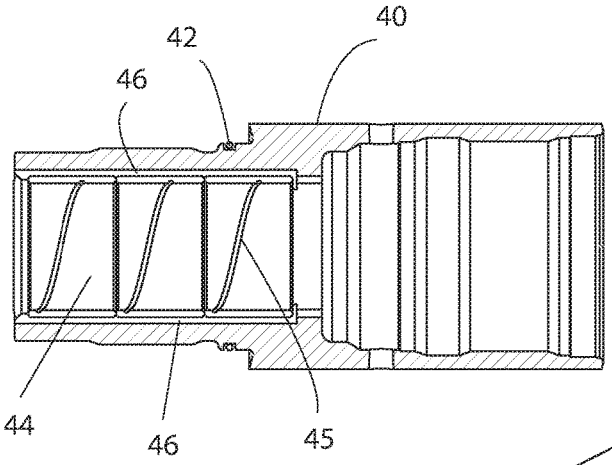
FIG. 6 is a partial cutaway view of a portion of one embodiment of the motor bearing and rotor catch system disclosed herein.

Still referring to FIG. 4, first on-bottom bearing 38 is shown installed around mandrel 15. In a presently preferred embodiment, first on-bottom bearing 38 is a three-part thrust bearing that includes from right to left (bottom to top) a mandrel race, a roller thrust cage, and a body race. A thrust housing 40 (also shown in FIG. 6) is shown with O-ring 42, bushing 44, and housing lubricant channels 46. Bushing 44 preferably includes spiral lubricant channel 48. After the first on-bottom bearing 38 is installed, the radial housing 24 and the thrust housing 40 are preferably attached with a threaded connection, although other forms of attachments are acceptable if the parts are securely attached. Although these two housing pieces are separately defined, they generally make up a singular housing along with other housing pieces described herein and can be singularly constructed if desired. In a presently preferred embodiment, the pieces are separate as shown to simplify assembly of the BHA.

Figure 7:
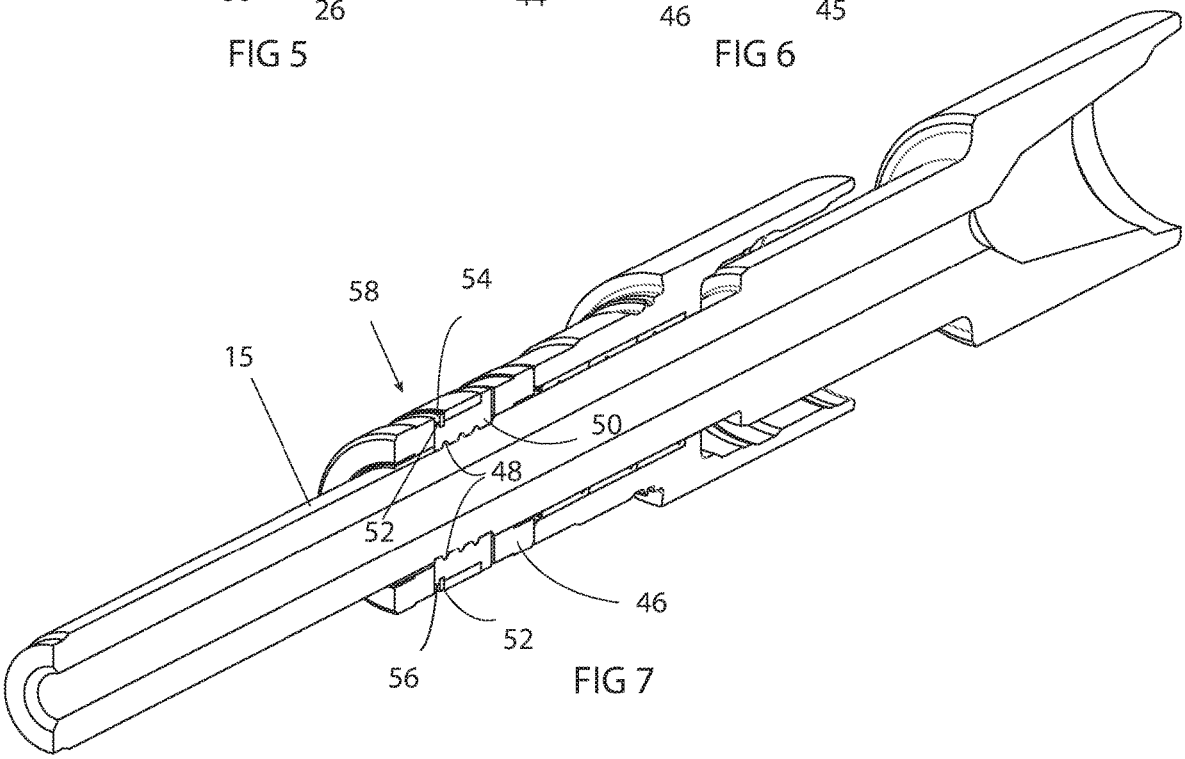
FIG. 7 is a partial cutaway view of a portion of one embodiment of the motor bearing and rotor catch system disclosed herein.

Again referring to FIG. 4 and now also to FIG. 7, indicated therein is an off-bottom thrust bearing 46 installed on the mandrel 15. Bearing 46 is also preferably a three-part thrust bearing that includes from right to left (bottom to top) a body race, a roller thrust cage, and a mandrel race, slid onto the mandrel 15 in that order. A compression wave spring 48 is then installed on the mandrel 15, followed by a clam shell 50, which includes retaining groove 52. A retaining bushing 54 is then installed on clam shell 50 and retaining ring 56 is installed in retaining groove 52.

Referring still to FIGS. 4 and 7, second on-bottom thrust bearing 58 is installed on the mandrel 15 adjacent the clam shell 50. As with the first on-bottom bearing 38, the second on-bottom thrust bearing 58 is also a three part thrust bearing that includes from right to left (bottom to top) a mandrel race, a roller thrust cage, and a body race, installed in that order.

Figure 8:
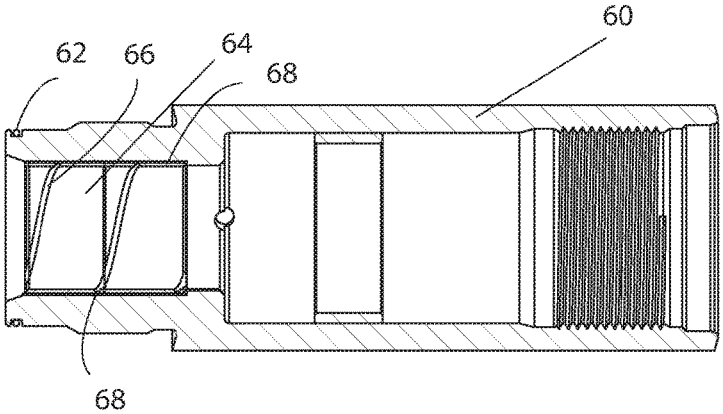
FIG. 8 is a partial cutaway view of a portion of one embodiment of the motor bearing and rotor catch system disclosed herein.

Referring again to FIG. 4 and now also to FIG. 8, after installation of the second on-bottom thrust bearing 58 a piston housing 60 is prepared by installing an O-ring 62 on and a bushing 64 into the piston housing 60. As with the previous bushings described above, bushing 64 preferably includes a spiral lubricant channel 66. Bushing 64 can be a unitary bushing or can be multiple bushings, as in a presently preferred embodiment. The piston housing 60 also preferably includes a housing lubricant channel 68 adjacent to the bushing 64. After installation of the O-ring 62 and the bushing 64, the piston housing 60 is preferably torqued to the thrust housing 40 by a threaded connection.

Figure 9:
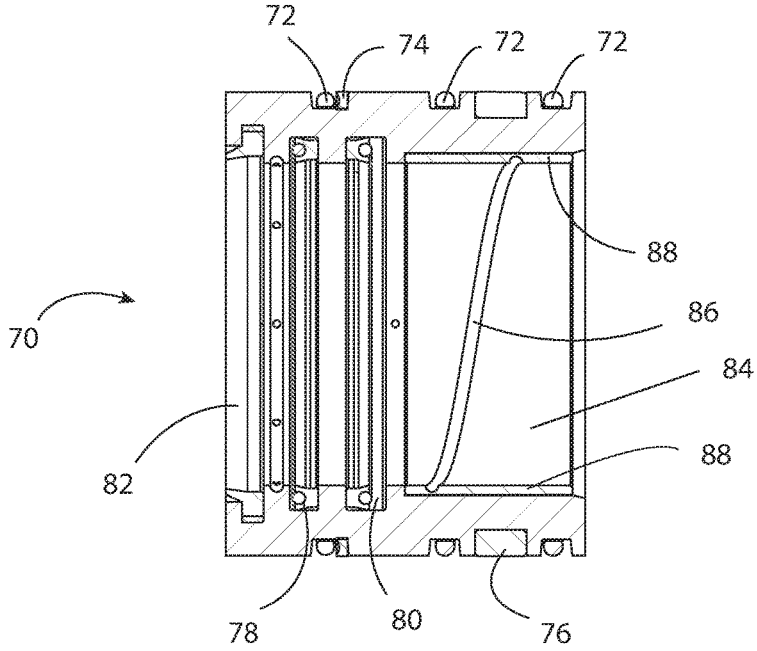
FIG. 9 is a partial cutaway view of a portion of one embodiment of the motor bearing and rotor catch system disclosed herein.
Figure 10:
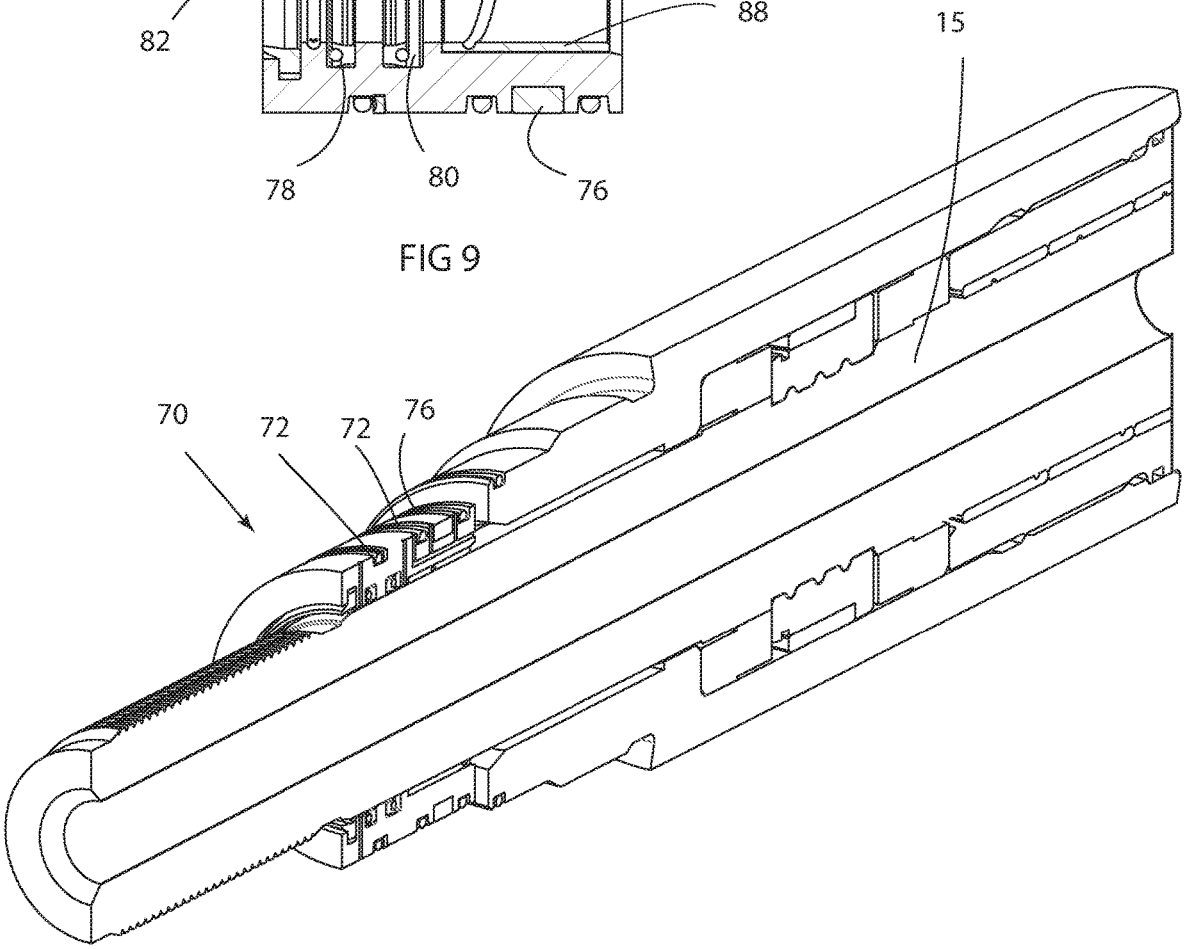
FIG. 10 is a partial cutaway view of a portion of one embodiment of the motor bearing and rotor catch system disclosed herein.
Figure 11:
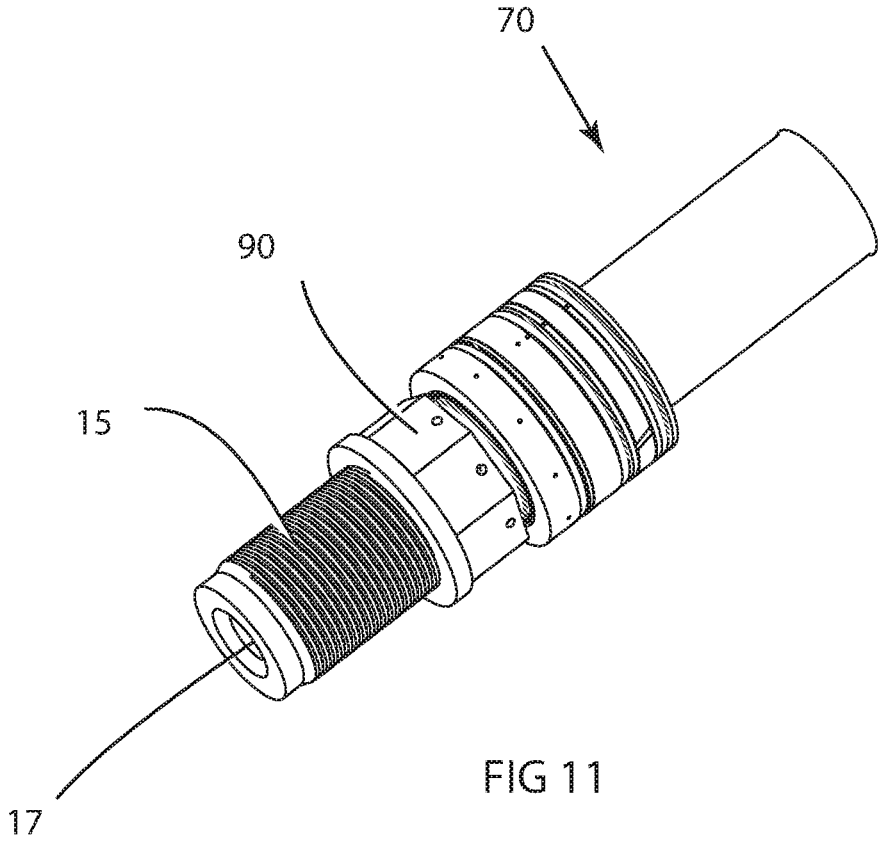
FIG. 11 is a perspective view a portion of one embodiment of the motor bearing and rotor catch system disclosed herein.
Figure 12:
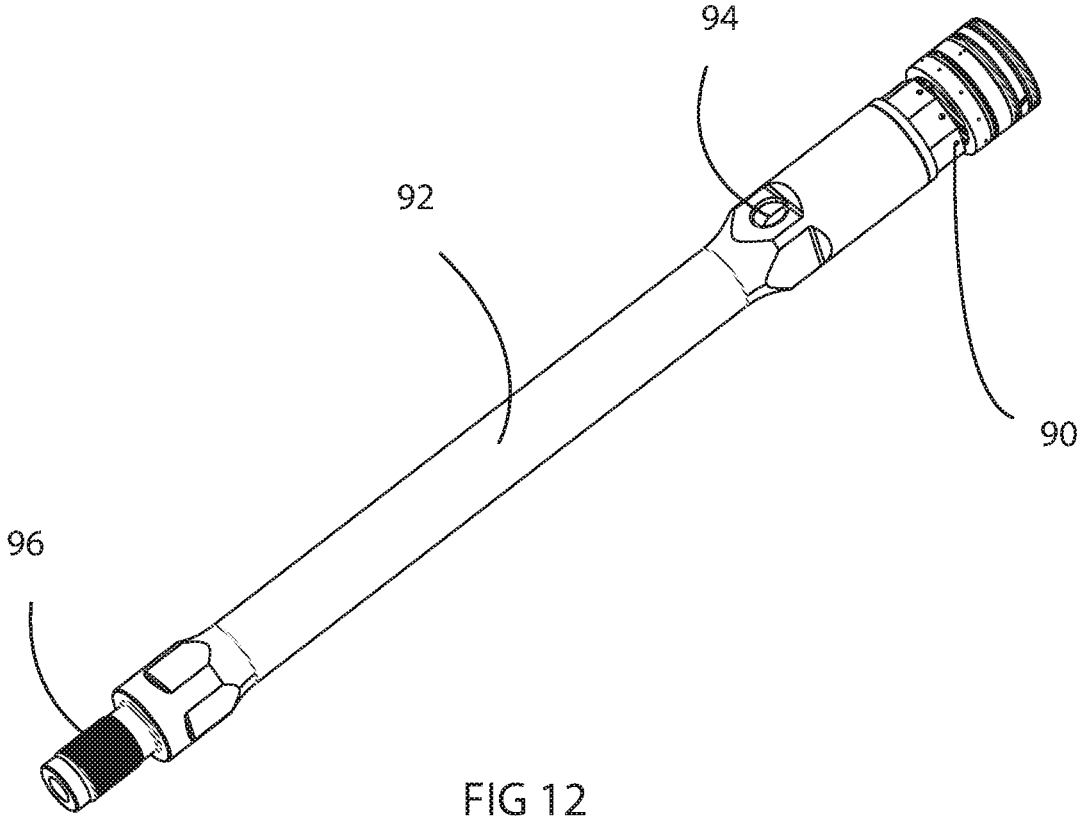
FIG. 12 is a perspective view a portion of one embodiment of the motor bearing and rotor catch system disclosed herein.

Still referring to FIG. 4 and now also FIG. 9, shown therein is a balance piston 70. In a presently preferred embodiment, the balance piston 70 includes O-rings 72, back-up O-ring 74, and wear ring 76. The balance piston 70 also preferably includes seals 78, 80, wiper seal 82, and balance piston bushing 84. As with prior bushings described above, the balance piston bushing 84 preferably includes a spiral lubricant channel 86 and the balance piston 70 includes piston lubricant channel 88. The cutaway perspective view of FIG. 10 demonstrates the balance piston 70 from a different angle that shows the various components of the balance piston 70 installed onto the mandrel 15. After installation of the balance piston 70 onto the mandrel 15, a flex shaft nut 90 is preferably threaded onto the mandrel 15. FIGS. 4, 11 and 12 show the flex shaft nut 90. The balance piston 70 effectively closes off the internal area described above that extends from the seals 26 in the radial housing 24 to the balance piston 70. This assembly is preferably filled with lubricant so that air is evacuated.

Figure 13:
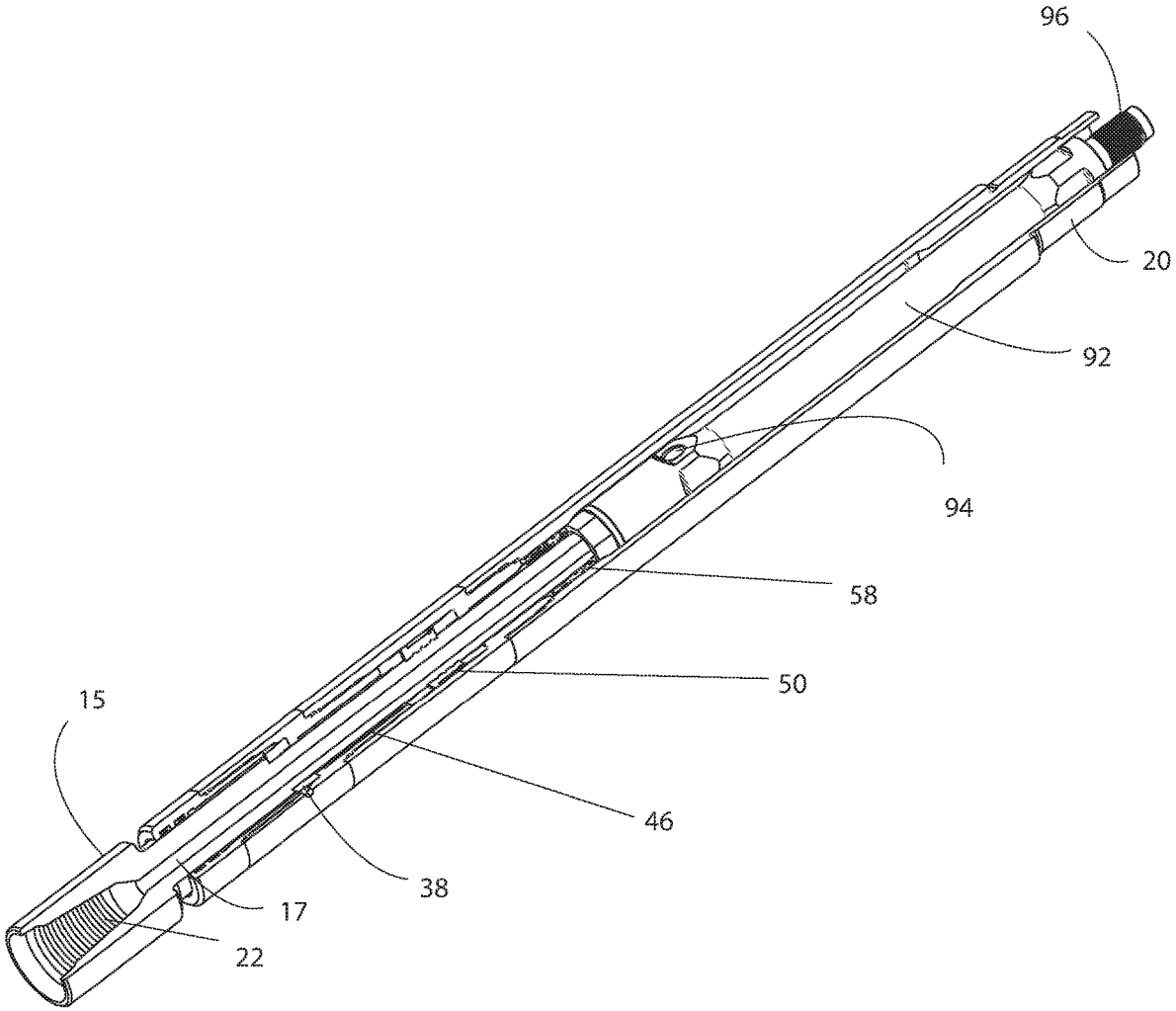
FIG. 13 is a partial cutaway view of a portion of one embodiment of the motor bearing and rotor catch system disclosed herein.

Referring now to FIG. 12, shown therein is flex shaft 92 attached to mandrel 15, preferably by a threaded connection. The flex shaft 92 can also be seen in FIG. 2 and partially in FIG. 4, and preferably includes passages 94 for the transmission of drilling mud into the fluid path 17 of the mandrel 15. In presently preferred embodiments, the flex shaft nut 90 is torqued to the flex shaft 92, which has threads 96 at its upper end. Referring also to FIG. 13, shown therein is a partial cutaway view of BHA 10 from the threaded portion 22 of the mandrel 15 to the top of the flex housing 20, including the flex shaft 92.

Again referring to FIGS. 1 and 2, the flex shaft 92 is shown threaded into rotor 98 with threads 96. Flex housing 100 is then torqued to piston housing 60 by sliding flex housing 100 over rotor 98, and stator 102 is threaded onto flex housing 100.

Figure 3:
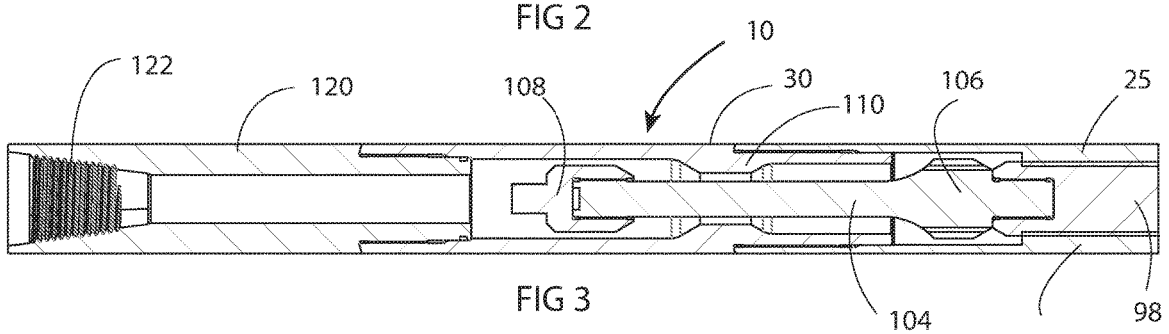
FIG. 3 is a partial cutaway view of a portion of one embodiment of the motor bearing and rotor catch system disclosed herein.

To add perspective to the arrangement above, FIG. 3 shows rotor catch housing 30 attached to stator 102, preferably by a threaded connection. Rotor catch shaft 104 is shown attached, preferably also by a threaded connection, to rotor 98, and includes enlarged portion 106 and rotor catch nut 108. In a presently preferred embodiment, the enlarged portion 106 of rotor catch shaft 104 is larger in diameter than the inner diameter of the stator 102. Similarly, the rotor catch nut 108 is larger in diameter than shoulder 110.

The rotor catch housing 30 is then preferably attached to top sub 120, also by a threaded connection. The top sub 120 is the upper end of the BHA 10 and is attached to drill pipe or coiled tubing at threads 122.

In use, coiled tubing (or drill pipe) is used with the BHA to drill a well. A drill bit connected to the inset portion 22 at the bottom of the mandrel 15 is positioned in the hole. Coiled tubing (or drill pipe) is attached to top sub 120 at threads 122 at the top of the BHA. Drilling mud is pumped at high pressure from the surface and downhole through the coiled tubing, making its way into the top sub 120. The drilling mud then continues into the rotor catch 30, passes the rotor catch shaft 104 and into the motor 25. As the drilling mud flows into the motor 25 the rotor 98 rotates relative to the stator 102. The drilling mud then flows between the stator 102 and the rotor 98 before reaching the flex shaft 92, where the drilling mud then flows between the housing 20 and the flex shaft 92. The drilling mud then enters the passages 94 in the flex shaft 92 where it then enters the upper end of the mandrel 15 and into the fluid path 17. As the rotor 98 spins, so does the flex shaft 92 and the mandrel 15, which in turn rotates the drill bit at the bottom end of the mandrel 15. The drilling mud then flows from the fluid path 17 into the spinning drill bit. Cuttings from the wellbore are then carried from the bottom of the hole up the sides of the BHA and the drill string to the surface.

During drilling, downward forces from the weight of the drill string and the drilling mud contribute to the drilling operation by adding weight to the BHA, also known as weight on bit. Although the weight is beneficial it can also cause problems related to wear on components of the BHA due to the extreme weight. First on bottom bearing 38 and second on bottom bearing 58 allow the internal rotating components to maintain proper radial positioning while also protection the components from the axial load. While the drill bit is on the bottom of the wellbore the on bottom bearings 38, 58 bear the axial load so other components within the BHA that are not designed for such extreme weight bearing axial loads do not.

Similarly, during a drilling operation the coiled tubing or drill string is occasionally removed from the wellbore or is raised above the bottom of the wellbore. In cases such as these, an axial load opposite of a weight bearing load acts to elongate the BHA. Off bottom bearing 46 also allows the internal rotating components to maintain proper radial positioning as the on bottom bearings 38, 58, yet protects the components of the BHA from an axial load acting opposite to the compressive load addressed above. With the thrust bearings discussed herein, the BHA is protected from forces acting in both axial directions while using redundant bearings for the heavier downward force typically seen by on bottom placement.

The rotating mandrel 15 is primarily contained within the radial housing 24, the thrust housing 40, the piston housing 60, and the flex housing 100. Lubricant within the various portions of the housing 20 protects the components within the housing 20 as the mandrel 15 rapidly rotates within the housing 20 by reducing heat and wear. Sleeves in the housing 20 such as bushings 32, 44, 64 help distribute the lubricant within the housing 20 as the mandrel 15 rotates. Spiral grooves in the bushings 32, 44, 64 allow lubricant in the housing 20 to migrate along the bushings 32, 44, 64 as the mandrel 15 rotates. The housing lubricant channels then allow the lubricant to migrate along the bushing so that the lubricant circulates along the bushings and back.

The balance piston 70 is the uppermost barrier that confines the lubricant within the housing 20. Because downhole conditions can include excessive heat and pressure, the lubricant can undergo expansion and contraction as the conditions change. The balance piston 70 allows the lubricant to escape from the housing 20 into the drilling mud near the top of the mandrel 15.

During horizontal drilling operations the BHA travels through tight turns in the wellbore that require that the drill string is flexible enough to continue operating while bending through the arcs of the wellbore. The flex shaft 92 is able to bend and thereby prevents damage to the BHA. However, it is very difficult to completely eliminate both damage to the BHA and the possibility of the BHA becoming lodged in the wellbore.

When the BHA becomes damaged or the drill bit becomes stuck in the wellbore, removing the drill string becomes risky as a portion of the BHA could remain in the wellbore, thereby requiring an expensive and time-consuming fishing operation. For example, if the drill bit becomes lodged in the wellbore, removal of the coiled tubing or drill pipe can result in the mandrel 15, along with the flex shaft 92 and the rotor 98 remaining in the wellbore. The rotor catch provides a safeguard for this possibility.

As the mandrel 15 begins to separate from the remaining BHA, the rotor catch shaft 104 helps prevent the mandrel from axial movement relative to the housing 20 and the rest of the drill string. As the drill string is raised from the surface, if the drill bit or other portion of the BHA below the rotor catch housing 30 is stuck in the hole, the mandrel 15, flex shaft 92, rotor 98, and rotor catch shaft 104 will move downhole relative to the rotor catch housing 30. The enlarged portion 106 of the rotor catch shaft 104 will contact the stator 102. As drilling fluid is still pumped downhole, the pressure will increase because the drilling fluid can no longer enter the mud motor as the enlarged portion 106 blocks the flow into the motor. The pressure increase is measurable at the surface and the operator is informed that the lower portion of the BHA is stuck in the hole. Likewise, the rotor catch nut 108 will also contact the shoulder 110 if the rotor catch shaft 104 moves far enough downward. The dual stage rotor catch provides an additional measure to decrease the likelihood that the rotor 98 or any other part of the BHA is lost in the wellbore.

While various embodiments usable within the scope of the present disclosure have been described, it should be understood that within the scope of the appended claims, the present invention can be practiced other than as specifically described. It should be understood by persons of ordinary skill in the art that an embodiment of the mud motor bearing and top sub rotor catch system in accordance with the present disclosure can comprise all of the features described above. It should also be understood that each feature described above can be incorporated into the mud motor bearing and top sub rotor catch system by itself or in combinations, without departing from the scope of the present disclosure.

What is claimed is:

1. A bottom hole assembly, comprising:

a housing having a housing lubricant channel;

a motor having a rotor and a stator, wherein the stator is attached to the housing;

a mandrel disposed within the housing that rotates when drilling mud flows through the motor;

a flex shaft within the housing and between the motor and the mandrel that includes an internal fluid path in the flex shaft for drilling mud to flow into the mandrel, wherein the drilling mud flows between the flex shaft and the housing at an upper end of the flex shaft and flows in the internal fluid path inside a lower end of the flex shaft;

a bushing between the housing and the mandrel having a spiral lubricant channel configured to pump lubricant while the mandrel rotates, such that lubricant in the housing lubricant channel returns to the spiral lubricant channel;

first and second on-bottom thrust bearings disposed between the housing and the mandrel; and a rotor catch housing attached to the stator and having an internal shoulder, a rotor catch shaft within the rotor catch housing, and a rotor catch nut attached to an upper end of the rotor catch shaft, wherein the rotor is attached to a lower end of the rotor catch shaft such that an enlarged portion of the rotor catch shaft is configured to engage the stator when the rotor moves in a downward direction and the rotor catch nut is configured to engage the internal shoulder when the rotor moves in a downward direction, and wherein the engagement of the internal enlarged portion and the stator or the rotor catch nut and the internal shoulder blocks the flow of drilling mud.

2. The bottom hole assembly of claim 1, further comprising an off bottom bearing between the mandrel and the housing.

3. The bottom hole assembly of claim 2, further comprising a retaining bushing between the off bottom bearing and the second on bottom bearing.

4. The bottom hole assembly of claim 1 wherein the flex shaft comprises titanium.

5. The bottom hole assembly of claim 1, further comprising a second housing lubricant channel, wherein the first and second housing lubricant channels are axially formed between the housing and the bushing.

6. The bottom hole assembly of claim 1, further comprising a balance piston around the mandrel configured to regulate pressure between the lubricant and the drilling mud.

7. A bottom hole assembly, comprising:

a housing having a housing lubricant channel;

a motor having a rotor and a stator, wherein the stator is attached to the housing;

a mandrel disposed within the housing that rotates when drilling mud flows through the motor;

a flex shaft within the housing and between the motor and the mandrel that includes an internal fluid path in the flex shaft for drilling mud to flow into the mandrel, wherein the drilling mud flows between the flex shaft and the housing at an upper end of the flex shaft and flows in the internal fluid path at a lower end of the flex shaft;

a bushing between the housing and the mandrel having a spiral lubricant channel configured to pump lubricant while the mandrel rotates, such that lubricant in the housing lubricant channel returns to the spiral lubricant channel;

first and second on-bottom thrust bearings disposed between the housing and the mandrel; and a rotor catch housing attached to the stator and having an internal shoulder, a rotor catch shaft within the rotor catch housing, and a rotor catch nut attached to an upper end of the rotor catch shaft, wherein the rotor is attached to a lower end of the rotor catch shaft such that an enlarged portion of the rotor catch shaft is configured to engage the stator when the rotor moves in a downward direction and the rotor catch nut is configured to engage the internal shoulder when the rotor moves in a downward direction, and wherein the engagement of the enlarged portion or internal shoulder blocks the flow of drilling mud.

8. The bottom hole assembly of claim 7, further comprising an off bottom bearing between the mandrel and the housing.

9. The bottom hole assembly of claim 8, further comprising a retaining bushing between the off bottom bearing and the second on bottom bearing.

10. The bottom hole assembly of claim 7 wherein the flex shaft comprises titanium.

11. The bottom hole assembly of claim 7, further comprising a second housing lubricant channel, wherein the first and second housing lubricant channels are axially formed between the housing and the bushing.

12. The bottom hole assembly of claim 7, further comprising a balance piston around the mandrel configured to regulate pressure between the lubricant and the drilling mud.

13. A bottom hole assembly, comprising: a motor having a rotor and a stator, wherein the rotor rotates when drilling mud is pumped into the motor; a flex housing having a flex shaft, wherein the flex shaft is attached to the rotor and a passage in the flex shaft transmits drilling mud; a mandrel attached to the flex shaft, wherein drilling mud that flows through the passage in the flex shaft flows into the mandrel; a housing attached to the flex housing, having a bushing between the housing and the mandrel and having a housing lubricant channel, wherein the bushing includes a spiral lubricant channel configured to pump lubricant while the mandrel rotates, such that lubricant in the housing lubricant channel returns to the spiral lubricant channel; and a rotor catch housing attached to the stator and having an internal shoulder, a rotor catch shaft within the rotor catch housing, and a rotor catch nut attached to an upper end of the rotor catch shaft, wherein the rotor is attached to a lower end of the rotor catch shaft such that an enlarged portion of the rotor catch shaft is configured to engage the stator when the rotor moves in a downward direction before the rotor catch nut engages the internal shoulder when the rotor moves in a downward direction, and wherein the engagement of the stator blocks the flow of drilling mud.

14. The bottom hole assembly of claim 13, wherein the flex housing is attached to the stator.

15. The bottom hole assembly of claim 14, further comprising a retaining bushing between the off bottom bearing and the second on bottom bearing.

16. The bottom hole assembly of claim 13, further comprising an off bottom bearing between the mandrel and the housing.

17. The bottom hole assembly of claim 13 wherein the flex shaft comprises titanium.

18. The bottom hole assembly of claim 13, further comprising a second housing lubricant channel, wherein the first and second housing lubricant channels are axially formed between the housing and the bushing.

19. The bottom hole assembly of claim 13, further comprising a balance piston around the mandrel configured to regulate pressure of the lubricant.

20. The bottom hole assembly of claim 19, further comprising a flex shaft nut attached to the mandrel that secures the balance piston.

* * * * *